US008522853B2

(12) United States Patent
Coleman et al.

(10) Patent No.: US 8,522,853 B2
(45) Date of Patent: Sep. 3, 2013

(54) CLOSURE ASSEMBLIES FOR FIRE DOORS, FIRE DOORS INCLUDING SUCH CLOSURE ASSEMBLIES AND METHODS OF LOCKING FIRE DOORS

(75) Inventors: W. Michael Coleman, Salt Lake City, UT (US); Duane O. Hall, Sandy, UT (US); E. Carl Goodman, Bountiful, UT (US); Michael D. George, Kaysville, UT (US); D. George Field, Pleasant Grove, UT (US)

(73) Assignee: Won-Door Corporation, Salt Lake City, UT (US)

( * ) Notice: Subject to any disclaimer, the term of this patent is extended or adjusted under 35 U.S.C. 154(b) by 318 days.

(21) Appl. No.: 12/582,802

(22) Filed: Oct. 21, 2009

(65) Prior Publication Data

US 2011/0088322 A1 Apr. 21, 2011

(51) Int. Cl.
*E06B 3/48* (2006.01)

(52) U.S. Cl.
USPC ..... 160/118; 292/DIG. 66

(58) Field of Classification Search
USPC ..... 160/1, 9, 118, 84.08, 84.09, 84.11; 292/DIG. 65, DIG. 66, 92, 131, 183, 184, 292/341.15; 49/1, 5, 7, 8
See application file for complete search history.

(56) References Cited

U.S. PATENT DOCUMENTS

| | | | | | |
|---|---|---|---|---|---|
| 1,438,547 | A | * | 12/1922 | O'Connor | 292/161 |
| 4,012,066 | A | * | 3/1977 | Salvatore | 292/341.13 |
| 4,189,173 | A | | 2/1980 | Rester | |
| 4,500,122 | A | * | 2/1985 | Douglas | 292/161 |
| 4,574,860 | A | * | 3/1986 | Weiss | 160/118 |
| 4,834,161 | A | | 5/1989 | Johnson et al. | |
| 4,924,929 | A | | 5/1990 | Johnson et al. | |
| 5,380,053 | A | * | 1/1995 | Saino | 292/144 |
| 5,527,074 | A | * | 6/1996 | Yeh | 292/177 |
| 5,542,720 | A | * | 8/1996 | Fleming | 292/32 |
| 6,296,038 | B1 | | 10/2001 | Chen | |
| 6,637,784 | B1 | * | 10/2003 | Hauber et al. | 292/300 |
| 6,935,662 | B1 | * | 8/2005 | Hauber et al. | 292/302 |
| 7,353,637 | B2 | | 4/2008 | Harger et al. | |
| 7,360,330 | B2 | * | 4/2008 | Abrams | 40/712 |
| 7,448,426 | B2 | | 11/2008 | Hsieh | |

* cited by examiner

*Primary Examiner* — David Purol
(74) *Attorney, Agent, or Firm* — TraskBritt

(57) ABSTRACT

In one embodiment, a closure assembly for a fire door, including a first lead post having a longitudinal cavity located therein, an opening extending through a wall of the first lead post into the longitudinal cavity and a locking member may be positioned within the longitudinal cavity that is configured to obstruct the opening into the longitudinal cavity upon reaching a predetermined temperature, is disclosed. In additional embodiments, fire doors including such closure assemblies and methods of locking fire doors are disclosed.

20 Claims, 6 Drawing Sheets

CLOSURE ASSEMBLIES FOR FIRE DOORS, FIRE DOORS INCLUDING SUCH CLOSURE ASSEMBLIES AND METHODS OF LOCKING FIRE DOORS

TECHNICAL FIELD

The invention relates to fire doors. In particular, embodiments of the invention relate to closure assemblies for fire doors, fire doors including such closure assemblies and methods of locking fire doors.

It is common practice in many public buildings, such as churches and hotels, to use folding doors as room dividers. In open, folded condition, the doors fit out of the way into compartments in a wall of a large room, and are extended across the room when division of the large room into smaller rooms is desired. While initially such doors were used merely as dividers, some are now constructed to meet certain fire resistant specifications and can be used as fire doors in buildings. Recently, such doors have begun to be used primarily as fire doors in condominiums, apartment and office building lobbies. When used as fire doors, the doors are normally open and, when a fire is sensed, are motor driven and automatically close. The doors themselves are not mechanically latched together since they have to remain manually operable for a period of time during a fire to be easily opened by people fleeing the fire. When used as fire doors, if a single door, the leading edge of the lead post assembly of the door generally fits into a receiving recess at the opposite side of the room from where the door is stored. If the door is a double or biparting door, a section of the door is stored on each of opposite sides of a room and the door comes together intermediate the sides of the room. In such an instance, one door section has the normal male leading edge on its lead post assembly that fits into a receiving female recess in the lead post assembly of the other door section. The lead post assemblies of such doors are generally constructed of a single metal channel or of metal pieces connected directly together along large contact areas such that heat is readily transmitted from one side of the lead post assembly to the other causing the entire lead post assemblies to get very hot. Further, especially with biparting doors, while the seal between the door sections is tight initially, after being subjected to intense fire heat of a period of time the lead post assemblies tend to warp and the doors come apart. This is not acceptable under many fire standards.

In view of the foregoing, improved closure assemblies for fire doors, fire door assemblies including such closure assemblies and methods of locking fire doors would be desirable.

BRIEF SUMMARY

In some embodiments, a closure assembly for a fire door may include a first lead post having a longitudinal cavity located therein and an opening extending through a wall of the first lead post into the longitudinal cavity. Additionally, a locking member may be positioned within the longitudinal cavity, and the locking member may be configured to obstruct the opening into the longitudinal cavity upon reaching a predetermined temperature.

In additional embodiments, a method of locking a fire door may include inserting an extending member comprising an enlarged end portion through an opening and into a cavity of a lead post, and heating the lead post to a predetermined temperature to cause a portion of a locking member enclosed within the cavity to move from a first position to a second position overlapping a portion of the opening and obstructing the opening to prevent the enlarged end portion of the extending member from being removed from the cavity of the lead post.

In yet additional embodiments a fire door may include a folding door section, a lead post at a leading end of the folding door section, a longitudinal cavity located within the lead post, and an opening into the longitudinal cavity. Additionally, the fire door may include a locking member positioned within the longitudinal cavity of the lead post, and the locking member may be configured to obstruct the opening into the longitudinal cavity upon reaching a predetermined temperature.

DETAILED DESCRIPTION

The illustrations presented herein are not meant to be actual views of any particular device or system, but are merely idealized representations that are employed to describe various embodiments of the present invention. It is noted that elements that are common between figures may retain the same numerical designation.

Figure 1:
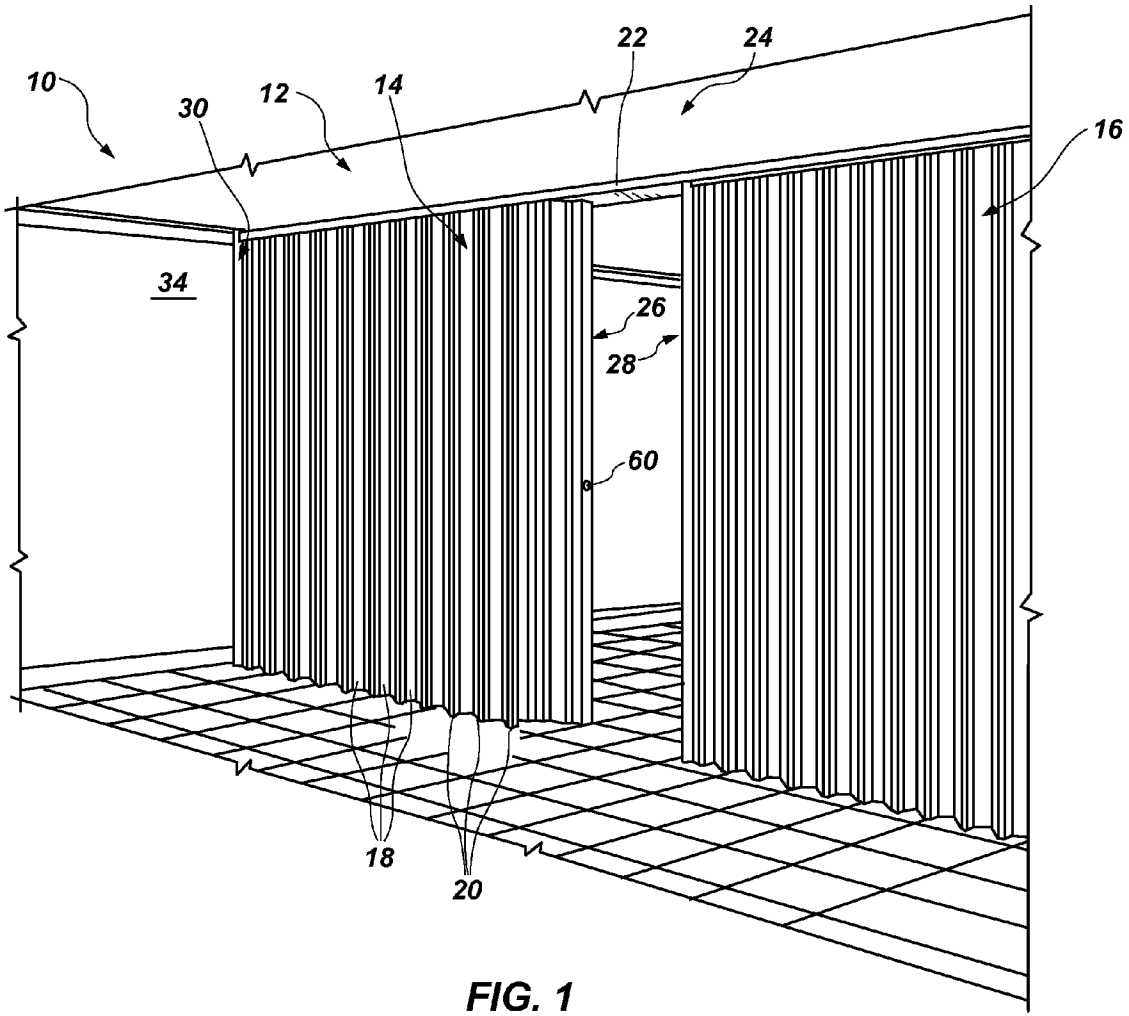
FIG. 1 shows a perspective pictorial view of a room including a biparting fire door assembly including a closure assembly according to an embodiment of the present invention.

As shown in FIG. 1, a room 10, such as a building lobby, may include one or more fire doors that may be comprised of one or more folding door sections.

For example, a biparting fire door 12 may include a first folding door section 14 and a second folding door section 16. Each folding door section 14 and 16 may include a plurality of panels 18 and each panel 18 of the plurality of panels 18 may be coupled to one or more adjacent panels 18 of the plurality of panels 18 with a hinge member 20. Furthermore, each folding door section 14 and 16 may be supported and suspended from an overhead track 22 by wheeled support structures (not shown). In view of this, each folding door section 14 and 16 may be configured to extend and retract along the overhead track 22.

The fire door 12 may also include a closure assembly 24 to seal the fire door upon closure and maintain a seal during a fire event. In some embodiments, the closure assembly 24 includes a first lead post assembly, such as a male lead post assembly 26 of the first folding door section 14, and a second lead post assembly, such as a female lead post assembly 28 of the second folding door section 16.

In the case of fire, the room 10 may be separated by the fire door 12 into two or more rooms. In view of this, the fire door 12 may be utilized to separate certain parts of a building, for example a building entrance may be separated from elevators, such as to prevent the spread of a fire and/or to facilitate a safe evacuation of personnel from the building.

Generally, when folding doors are installed as fire doors, the doors are motor driven so that in the event of a fire, which may be sensed by a fire sensing system, the doors automatically close to provide a desired fire barrier. The use of the fire doors to separate a building entrance from elevators is merely an example of where such doors are commonly used, and the doors may be used generally in any location where desired or required by fire codes.

Figure 2:
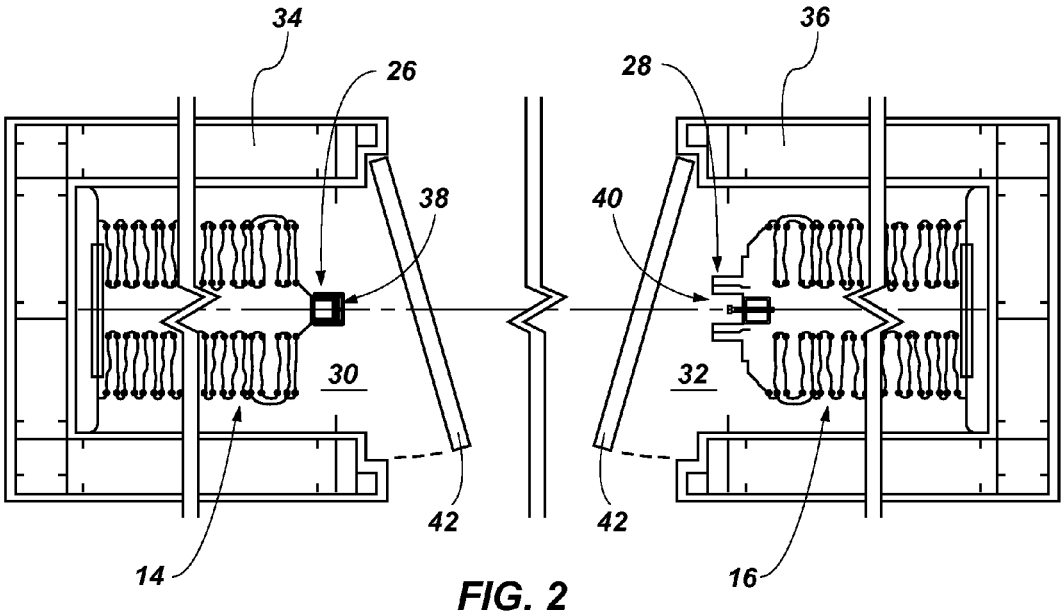
FIG. 2 shows a horizontal cross-sectional view of the biparting fire door of FIG. 1 contained in recesses within walls of the room.

When open, the folding door sections 14 and 16 are folded and may be housed out of the way in recesses 30 and 32 in walls 34 and 36 respectively (as further shown in FIG. 2). Upon activation, such as by an automated fire detection system or by an operator, the folding door sections 14 and 16 may be carried upon and distributed along the overhead track 22. The male lead post assembly 26 may form an extended leading end 38 for the first folding door section 14, while the female lead post assembly 28 of the second folding door section 16 may form a receiving groove 40 for the leading end 38 of the male lead post assembly 26, 26 when the first and second folding door sections 14 and 16 come together in a closed position; this may create a closure for the fire door 12. Additionally, the closure assembly 24 includes locking devices (shown in FIGS. 4A through 6C) that may lock the lead post assemblies 26 and 28 together upon reaching a predetermined temperature, which may prevent the severe heat from a fire from causing the lead post assemblies 26 and 28 to separate, such as due to warping.

As shown in FIG. 2, the first and second folding door sections 14 and 16 may be coupled to and stowed within respective recesses 30 and 32 formed within walls 34 and 36 of the room 10, which may optionally include hinged covers 42. As shown in the cross-sectional view of FIG. 2, the male lead post assembly 26 of the first folding door section 14 is sized and configured to fit at least partially within the receiving groove 40 of the female lead post assembly 28 of the second folding door section 16 to form a closure when the folding door sections 14 and 16 are fully extended. Also, while FIG. 1 shows a straight overhead track 22, in some embodiments the overhead track 22 may be curved, and the door 12, when closed, may extend in an arcuate line between walls 34 and 36 of the room 10.

Figure 3:
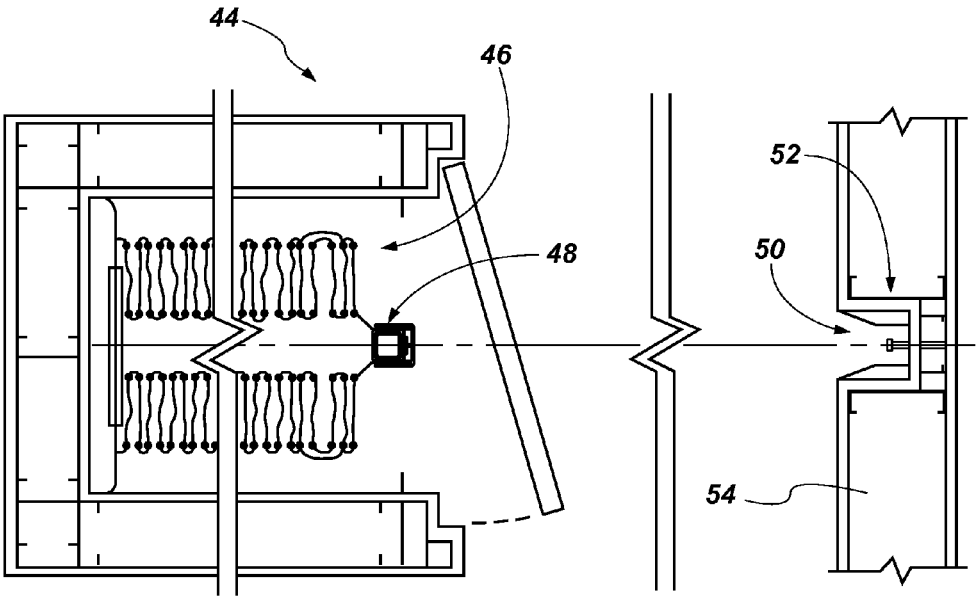
FIG. 3 shows a horizontal cross-sectional view of a single parting fire door assembly including a closure assembly according to an embodiment of the present invention.

While FIGS. 1 and 2 show two folding door sections 14 and 16, which form what is referred to as a biparting door 12, in many instances, depending upon the length of door needed, a single door section may be used to stretch along the entire length of a track from wall to wall to form a single parting fire door 44 as shown in FIG. 3. In such an instance, a door section 46 may have a male lead post assembly 48, similar to that described with reference to the male lead post assembly 26 first folding door section 14 of the biparting fire door 12, which may mate with a receiving groove 50 of a striker assembly 52 mounted in a recess in a wall 54 to which the door 44 extends. As shown, the receiving groove 50 may be formed by the striker assembly 52, which may be made of steel or other suitable material and dimensioned to fit within a larger recess formed in the wall 54. In addition, while not illustrated, those of ordinary skill in the art will recognize that the receiving groove 50 may be positioned on the single parting fire door 44 and the male lead post assembly 48 may be positioned in the recess in the wall 54.

As previously mentioned, when the temperature on one side of a folding fire door gets hot, such as due to a fire, there is a possibility that the lead posts will warp and may separate. To prevent this separation, a locking device may be provided to mechanically lock the doors together. Such mechanical locking is not always desirable, however, for example, when people may be fleeing the fire and must open the door to escape. In view of this, the present invention provides a temperature-sensitive locking apparatus that may mechanically lock the male and female lead post assemblies together only when the temperature on the fire side of the door reaches a predetermined temperature. This predetermined temperature may be less than the temperature that causes warping of the lead posts to ensure that the lead posts are locked by the time they reach warping temperature, but may also be sufficiently high so there could no longer be life trying to escape from the fire. For example, the predetermined minimum temperature may be about 500 degrees F. Embodiments of closure assemblies for fire doors including such locking devices are shown in FIGS. 4A through 6C.

Figure 4A:
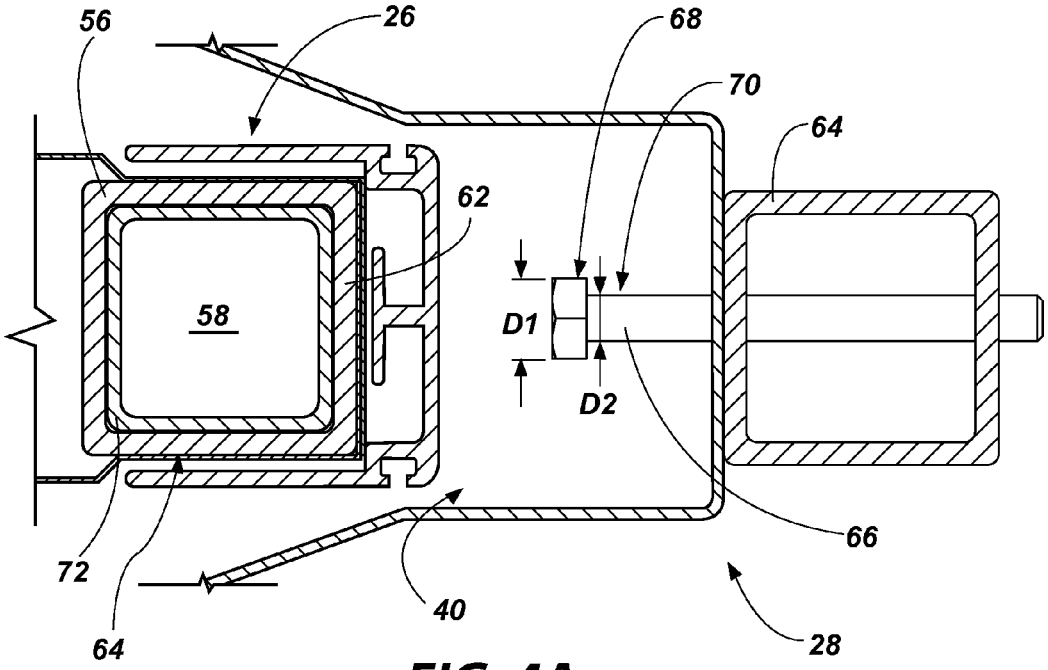
FIG. 4A shows a horizontal cross-sectional detail view of the closure assembly of the fire door of FIGS. 1 and 2 in a separated, open configuration.

As shown in the detail cross-sectional view of the closure assembly 24 of the fire door 12 illustrated in FIG. 4A, the male lead post assembly 26 of the first folding door section 14 may include a central post 56 which defines a longitudinal cavity 58 therein. For example, the central post 56 may be a steel rectangular tube, having a generally rectangular cross-section, which extends vertically along substantially the entire length of the extended leading end 38 of the first folding door section 14. An opening 60 (FIGS. 1 and 6A-6C) extends into the longitudinal cavity 58, such as through a wall 62 at the leading end of the central post 56.

Figure 4B:
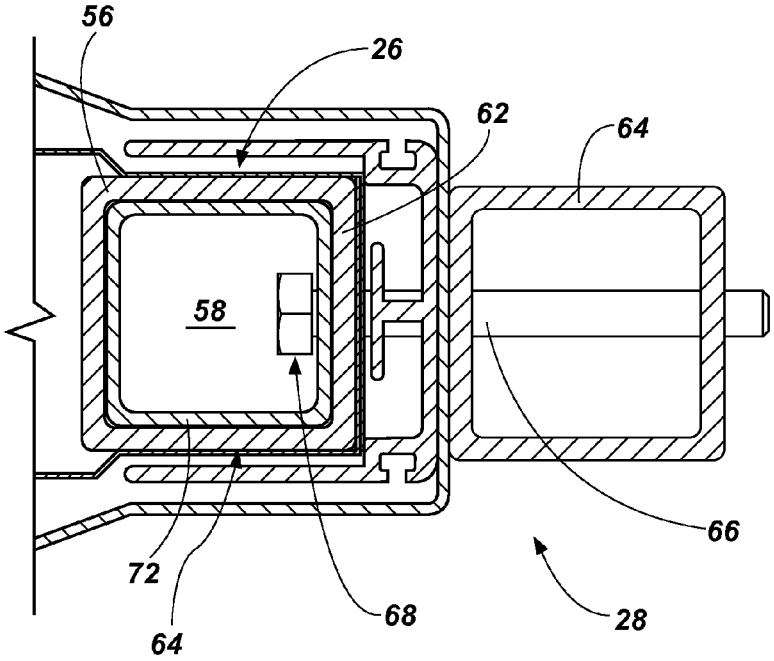
FIG. 4B shows a horizontal cross-sectional detail view of the closure assembly of FIG. 4A in a closed configuration.

The female lead post assembly 28 of the second folding door assembly section 16 may include a central post 64, which may be located at the base of the receiving groove 40. The central post 64 of the female lead post assembly 28 may be formed of an elongated member that extends substantially along the length of the receiving groove 40 and may provide structural stability to the female lead post assembly 28. For example, the central post 64 may be a rectangular tubular member, having a generally rectangular cross-section, which may be made of steel or another suitable material. Additionally, the female lead post assembly 28 may include an extending member 66 located within the receiving groove 40 and attached to the central post 64. The extending member 66 may be additionally sized and located to extend through the opening 60 and into the cavity 58 of the central post 56 of the male lead post assembly 26 when the folding door sections 14 and 16 are extended and the leading end 38 of the male lead post assembly 26 is positioned within the receiving groove 40 of the female lead post assembly 28 (as shown in FIG. 4B). For example, the opening 60 of the male lead post assembly 26 may be located at or near the center of the leading end 38 of the male lead post assembly 26 and the extending member 66 may be located at or near the center of the receiving groove 40 of the female lead post assembly 28. The extending member 66 may include an enlarged end portion 68 (e.g. a head) and a recessed portion 70 (e.g. a shank), and the enlarged end portion 68 may have a diameter D1 that is larger than a diameter D2 of the recessed portion 70. As a non-limiting example, the extending member may be a bolt, such as one of a carriage bolt, a hex bolt, and a shoulder bolt. The recessed portion 70 of the extending member 66 may comprise a portion of the shank of a bolt and the enlarged end portion 68 of the extending member 66 may comprise the head of the bolt. The enlarged end portion 68 of the extending member may be sized and shaped similar to the opening 60 in the male lead post and a diameter D1 that is smaller than a diameter D3 of the opening 60 (FIG. 6A) to allow the passage of the enlarged end portion 68 through the opening 60. For example, the opening 60 may be generally cylindrical in shape, having a generally circular cross-section. Likewise, the opening 60 may be sized just larger than the enlarged end portion 68 of the extending member 66, which may allow a relatively small opening 60 in the male lead post assembly 26 for safety and aesthetic reasons. For example a relatively small opening 60 may be less visible and may reduce the risk of foreign objects being inserted into the opening 60 and hindering the proper operation of the closure assembly 24.

Figure 5A:
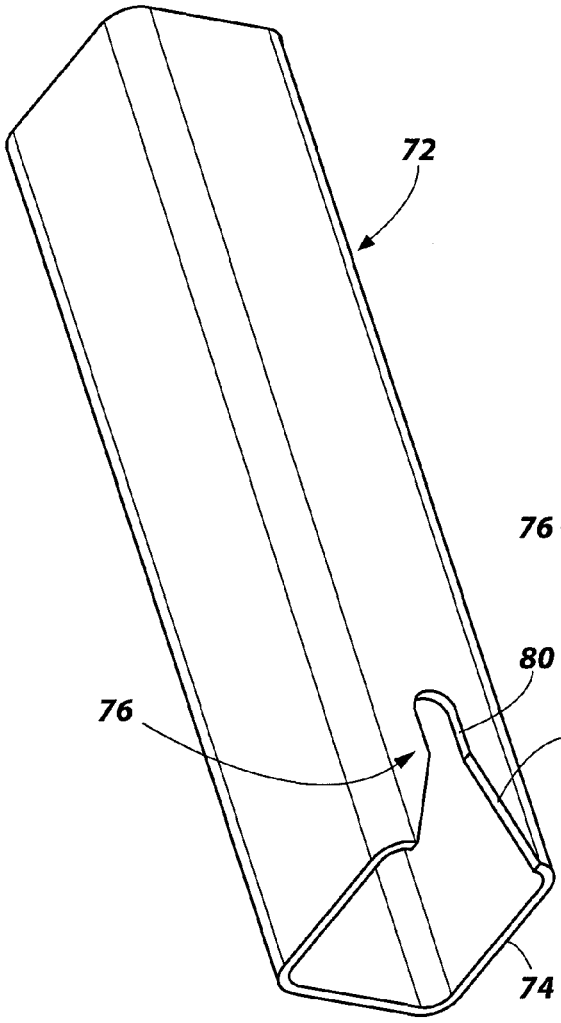
FIG. 5A shows an isometric pictorial view of a locking member of the closure assembly of FIGS. 4A and 4B.
Figure 5B:
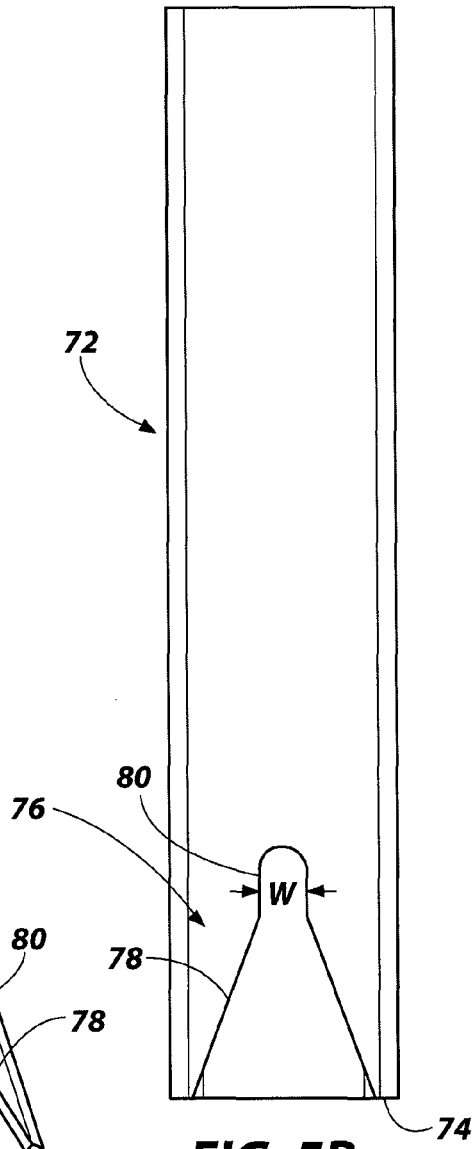
FIG. 5B shows a front view of the locking member of FIG. 5A.
Figure 5C:
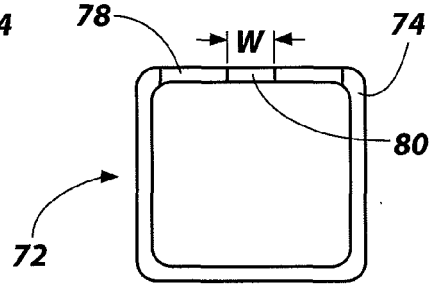
FIG. 5C shows a bottom view of the locking member of FIGS. 5A and 5B.

A locking member 72 may be positioned within the cavity of the male lead post, and at least a portion of the locking member 72 may be positioned above the opening 60 within the central cavity 58. In view of this, the locking member 72 may be completely enclosed within the central cavity 58 of the central post 56 of the male lead post assembly 26, and may not be visible from the outside. In one embodiment, as shown in FIGS. 5A-5C, the locking member 72 may be made from a rectangular tube, such as a square tube, which may have a generally rectangular cross-section, such as a square cross-section, made of steel or another suitable material. The locking member 72 may have a bottom end 74 having a locking feature 76 formed therein. For example, the locking feature 76 may be cut into a tube, such as by a milling machine. The locking feature 76 may comprise a tapered portion 78 and a slot 80. The tapered portion 78 may extend from the bottom end 74 of the locking member 72 to the slot 80. The slot 80 may be defined by a width W that is larger than the diameter D2 defining the recessed portion of the extending member 66 and smaller than the diameter D1 defining the enlarged end portion 68 of the extending member 66.

Figure 6A:
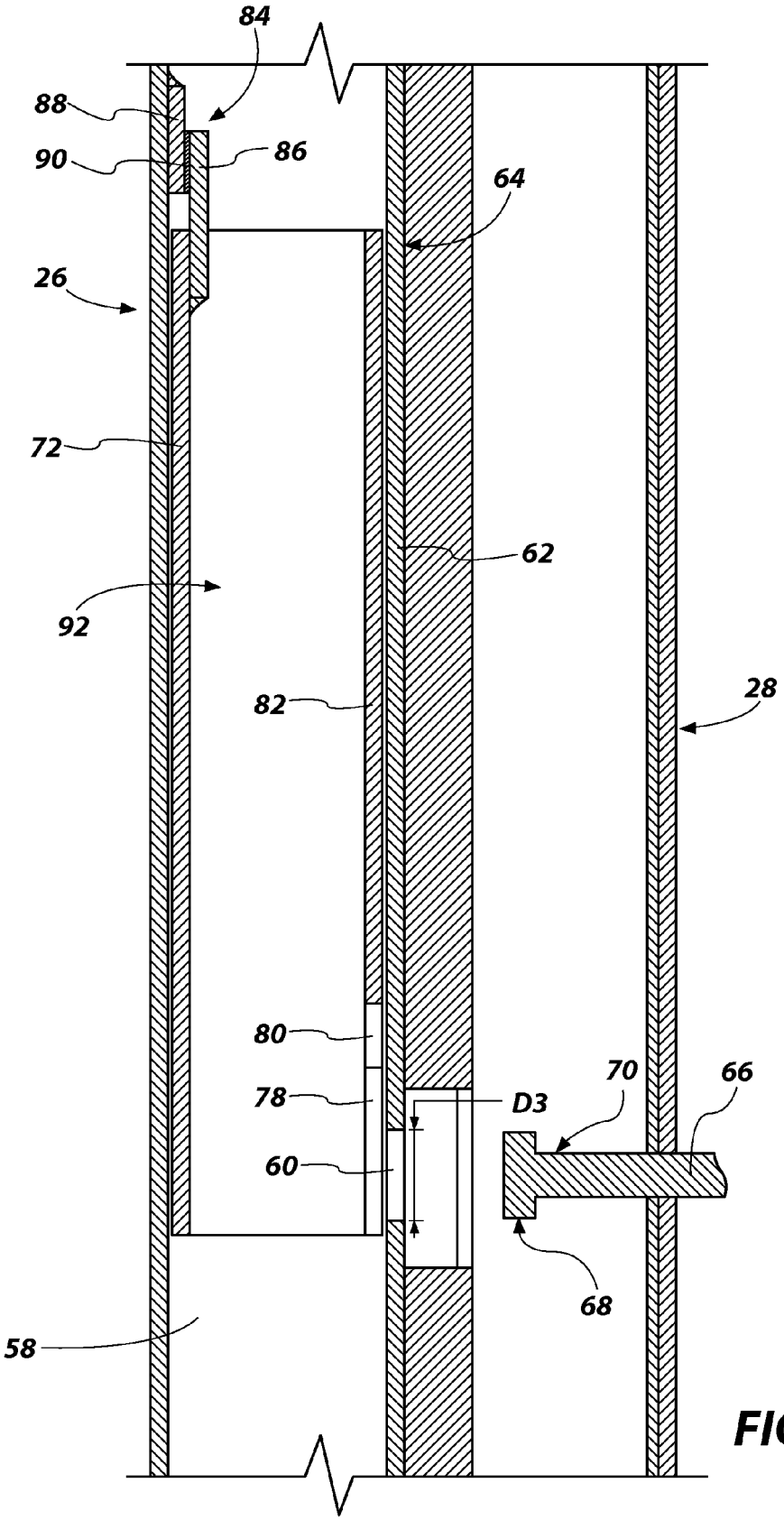
FIG. 6A shows a vertical cross-sectional detail view of the closure assembly of the fire door of FIGS. 1 and 2 in a separated, open configuration.

As shown in FIG. 6A, a wall 82 of the locking member 72 having the locking feature 76 formed therein may be positioned adjacent to the wall 62 at the leading end of the central post 56 of the male lead post assembly 26, having the opening 60 formed therein, and the slot 80 of the locking feature 72 may be positioned above the opening 60. Additionally, a fusible link 84 may be attached to the locking member 72 and to the central post 64 of the male lead post assembly 26 and may support the locking member 72 within the central post 64. The fusible link 84 may include a first member 86 attached to the locking member 72, a second member 88 attached to the central post 64, and a fusible material 90 positioned between the first member 86 and the second member 88. For example, the fusible material 90 may be a metal alloy configured to melt at a predetermined temperature, such as about 500 degrees F.

Figure 6B:
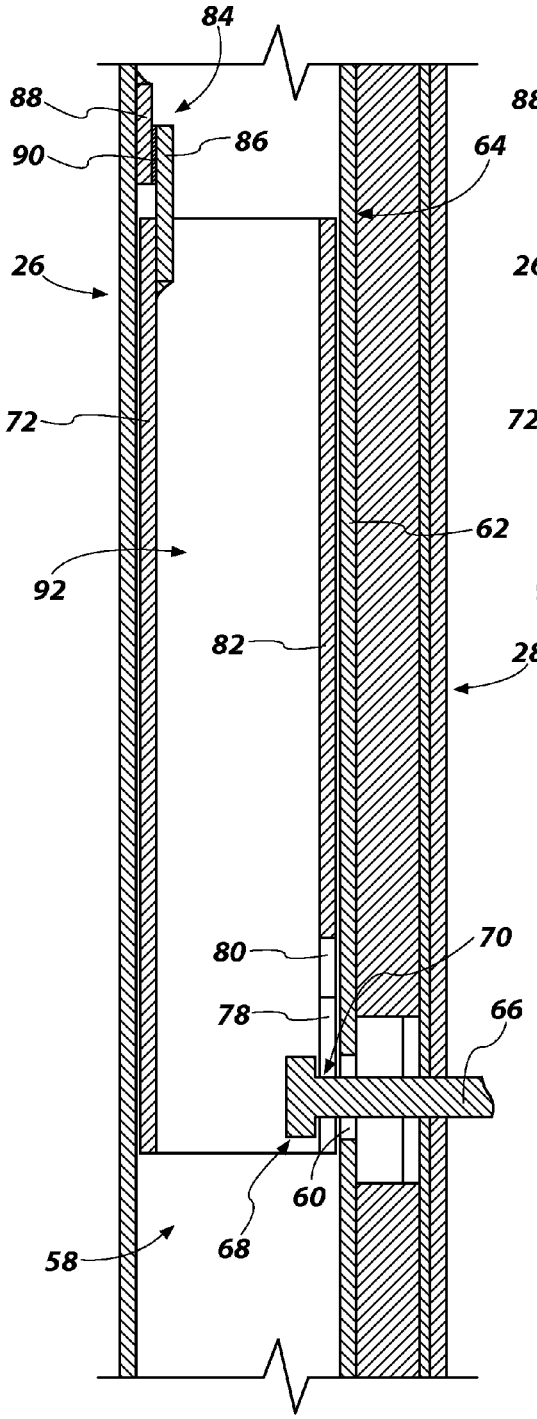
FIG. 6B shows a vertical cross-sectional detail view of the closure assembly of FIG. 6A in a closed configuration.

As shown in FIG. 6B, when the leading end 38 of the male lead post assembly 26 is received within the receiving groove 40 of the female lead post assembly 28, the extending member 66 may extend into the cavity 58 of the central post 56 of the male lead post assembly 26. The slot 80 of the locking member 72 may be positioned above the recessed portion 70 of the extending member 66 and a longitudinal cavity 92 of the locking member 72 may extend over the enlarged end portion 68 of the extending member 66.

Figure 6C:
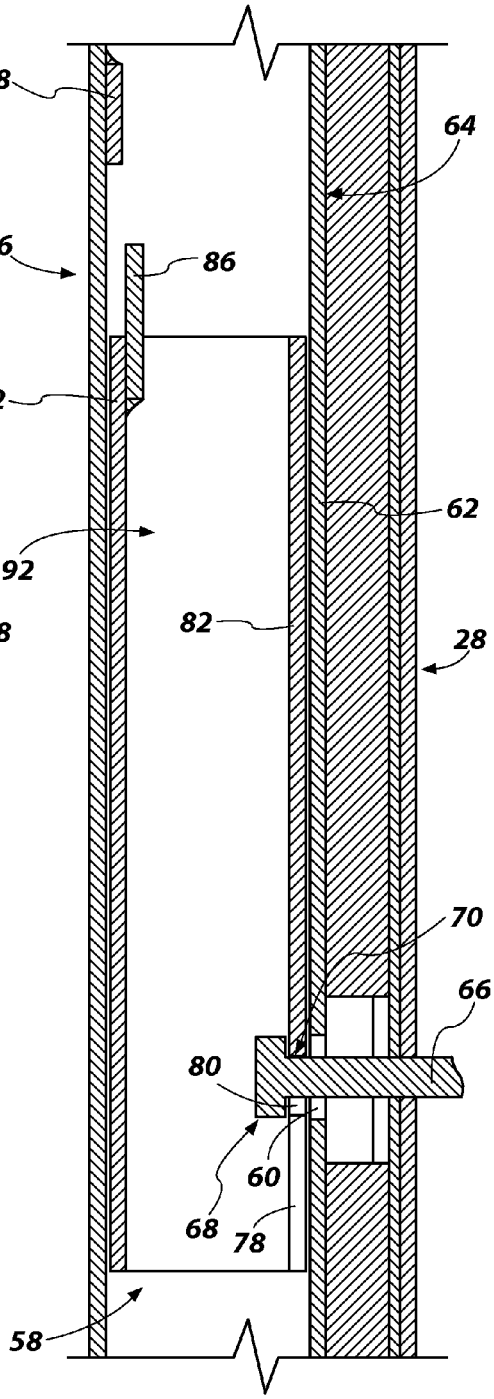
FIG. 6C shows a vertical cross-sectional detail view of the closure assembly of FIGS. 6A and 6B in a closed and locked configuration.

As shown in FIG. 6C, when the closure assembly 24 reaches a predetermined temperature, for example, about 500 degrees F., the locking member 72 may move toward the opening 60. For example, when heated to the predetermined temperature, the fusible material 90 of the fusible link 84 may melt and the first member 86 and the second member 88 of the fusible link may become separated and the fusible link 84 may no longer support the locking member 72. A biasing force may then cause the locking member 72 to be moved toward the opening 60. For example, the biasing force may be solely a gravitational force acting on the locking member 72. Although other biasing forces may be used, gravitation force may provide a simple, reliable means to bias the locking member 72 and, unlike other biasing means such as springs and elastic material, may not be damaged by heat from a fire.

As the locking member 72 falls toward the opening 60, and the extending member 66 positioned therethrough, the tapered portion 78 and the slot 80 of the locking member 72 may interact with the recessed portion 70 of the extending member 66. For example, if the slot 80 of the locking member 72 is not completely aligned with the recessed portion 70 of the extending member 66, the tapered portion 78 may contact the recessed portion 70 of the extending member 66 and may cause the slot 80 of the locking member 72 to become aligned with the recessed portion 70 of the extending member 66 as the locking member 72 falls from a first position above the opening 60 into a second, locked position. The slot 80 of the locking member 72 may extend over the recessed portion 70 of the extending member 66 and a top portion of the slot 80 may contact a top portion of the recessed portion 70 of the extending member 66 and cause the locking member 72 to stop, and may hold the locking member 72 in the locked position, as shown in FIG. 6C. In the locked position, a portion of the locking member 72 surrounding the slot 80 may obstruct the opening 60 to the longitudinal cavity 58 in the central post 56 of the male lead post assembly 26. This obstruction of the opening 60 may prevent the enlarged end portion 68 of the extending member 66 from passing through the opening 60 and may prevent the extending member 66 from being removed from the longitudinal cavity 58 of the male lead post assembly 26 and may hold the male lead post assembly 26 and the female lead post assembly 28 together. By providing this mechanical lock, the closure assembly may prevent the separation of the lead post assemblies 26 and 28 and maintain an appropriate fire barrier, even under the heat of a fire that may otherwise warp and separate the closure assembly of a conventional fire door.

In view of the foregoing, a closure assembly may be provided that improves the reliability, safety and visual aesthetics of a fire door. A closure assembly may be provided that includes a single moving part (relative to a lead post), which may be biased solely by gravity, and which may be reliably activated. Additionally, all of the moving parts (relative to a lead post) are completely enclosed within the closure assembly, which may prevent tampering or inadvertent damage of the locking mechanism. The extending member may be positioned within a recess of a receiving channel, which may prevent damage of the extending member and may prevent people or objects from becoming caught on the extending member. Furthermore, the opening may be sized relatively small, which may improve the aesthetics of the fire door and may prevent tampering or inadvertent damage of the closure assembly.

Whereas the invention is illustrated and described herein with reference to specific embodiments thereof, it is to be understood that various changes may be made in adapting the invention to different embodiments without departing from the broader inventive concepts disclosed herein and comprehended by the claims that follow. For example, a closure assembly for a fire door may include multiple locking features, rather than a single locking feature as described. Additionally, the closure assemblies described may be used with any of a number of fire door configurations.

Although this invention has been described with reference to particular embodiments, the invention is not limited to these described embodiments. Rather, the invention is limited only by the appended claims, which include within their scope all equivalent devices, systems and methods.

What is claimed is:

1. A closure assembly for a fire door comprising:

a first lead post configured to extend along a substantial length of a leading end of a fire door, the first lead post comprising:

a longitudinal cavity located within the first lead post, the longitudinal cavity extending parallel with the first lead post;

an opening extending through a wall of the first lead post into the longitudinal cavity; and a locking member located completely within the longitudinal cavity, the locking member configured to obstruct the opening into the longitudinal cavity upon reaching a predetermined temperature.

2. The closure assembly of claim 1, further comprising a fusible link supporting the locking member and configured to release the locking member at the predetermined temperature to allow a portion of the locking member positioned above the opening to move toward and obstruct the opening.

3. A closure assembly for a fire door comprising:

a first lead post, the first lead post comprising:

a longitudinal cavity located within the first lead post;

an opening extending through a wall of the first lead post into the longitudinal cavity; and a locking member positioned within the longitudinal cavity, the locking member configured to obstruct the opening into the longitudinal cavity upon reaching a predetermined temperature;

a receiving member configured to mate with the first lead post to form a closure, the receiving member comprising an extending member sized and positioned to extend into the longitudinal cavity of the first lead post through the opening upon mating of the first lead post and the receiving member, and the extending member comprising a recessed portion; and wherein the portion of the locking member positioned above the opening is configured to interact with the recessed portion of the extending member upon falling and prevent the removal of the extending member of the receiving member from the longitudinal cavity of the first lead post.

4. The closure assembly of claim 3, wherein the extending member further comprises an enlarged end portion having a diameter larger than a diameter of the recessed portion, the enlarged end portion configured to extend into the longitudinal cavity of the first lead post.

5. The closure assembly of claim 4, wherein the portion of the locking member positioned above the opening is further configured to prevent removal of the enlarged end portion upon falling and obstructing the opening.

6. The closure assembly of claim 5, wherein:

the extending member comprises a bolt having a shank and a head;

the recessed portion of the extending member comprising a portion of the shank of the bolt;

the enlarged end portion of the extending member comprising the head of the bolt; and the head and the portion of the shank of the bolt is sized and positioned to extend into the cavity of the first lead post through the opening upon mating of the first lead post and the receiving member.

7. The closure assembly of claim 2, wherein the fusible link comprises a material configured to melt at the predetermined temperature.

8. The closure assembly of claim 1, wherein:

the first lead post comprises an outer tube defining the longitudinal cavity therein and including the opening extending therethrough; and the locking member comprises an inner tube having a slot formed therein and the inner tube being enclosed within the outer tube.

9. The closure assembly of claim 8, wherein each of the inner tube and the outer tube comprise a generally rectangular cross-section.

10. The closure assembly of claim 9, wherein the opening of the first lead post is defined by a diameter and the slot formed in the locking member is defined by a width, and wherein the width of the slot is smaller than the diameter of the opening.

11. The closure assembly of claim 10, wherein the locking member further comprises a tapered portion extending to and narrowing toward the slot.

12. The closure assembly of claim 11, wherein the opening in the first lead post is a generally cylindrical shaped opening.

13. The closure assembly of claim 3, further comprising a first folding door section attached to the first lead post.

14. The closure assembly of claim 13, wherein the receiving member is comprised of a second lead post, and the second lead post is attached to a second folding door section.

15. The closure assembly of claim 13, wherein the receiving member is comprised of a striker assembly.

16. The closure assembly of claim 15, wherein the striker assembly is configured to be mounted within a cavity of a wall.

17. A method of locking a fire door, the method comprising:

inserting an enlarged end portion of an extending member through an opening and into a cavity of a lead post; and heating the lead post to a predetermined temperature to cause a locking member completely enclosed within the cavity to move from a first position to a second position overlapping a portion of the opening and interacting with the enlarged end portion of the extending member to prevent the extending member from being removed from the cavity of the lead post.

18. The method of claim 17, further comprising:

supporting the locking member with a fusible link; and wherein heating the lead post to the predetermined temperature further comprises heating the fusible link to cause the fusible link to release the locking member.

19. The method of claim 18, further comprising moving the locking member from the first position to the second position solely by a gravitational force.

20. A fire door comprising:

a folding door section; and a lead post extending along a substantial length of a leading end of the folding door section, the lead post comprising:

a longitudinal cavity located within the lead post, the longitudinal cavity extending parallel with the first lead post;

an opening into the longitudinal cavity; and a locking member located completely within the longitudinal cavity, the locking member configured to interact with an extending member positioned in the longitudinal cavity upon reaching a predetermined temperature.

* * * * *